US011525359B1

(12) United States Patent
Binek et al.

(10) Patent No.: US 11,525,359 B1
(45) Date of Patent: Dec. 13, 2022

(54) HEAT PIPE FOR A TURBINE ENGINE

(71) Applicant: Raytheon Technologies Corporation, Farmington, CT (US)

(72) Inventors: Lawrence A. Binek, Glastonbury, CT (US); David W. Morganson, Marlborough, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 17/333,532

(22) Filed: May 28, 2021

(51) Int. Cl.
*F01D 5/18* (2006.01)
*F01D 9/04* (2006.01)

(52) U.S. Cl.
CPC ..... *F01D 5/181* (2013.01); *F01D 9/041* (2013.01); *F05D 2260/208* (2013.01)

(58) Field of Classification Search
CPC ..... F01D 5/181; F01D 9/041; F05D 2260/208
See application file for complete search history.

(56) References Cited

U.S. PATENT DOCUMENTS

| | | | | |
|---|---|---|---|---|
| 10,450,957 | B2 | 10/2019 | Pearson | |
| 10,472,984 | B2 | 11/2019 | Norton | |
| 10,605,213 | B2 | 3/2020 | Peters | |
| 2014/0165570 | A1 | 6/2014 | Herring | |
| 2016/0305279 | A1 | 10/2016 | Gerstler | |
| 2017/0089645 | A1* | 3/2017 | Sharp | F28D 15/02 |
| 2017/0363007 | A1 | 12/2017 | Jinquan | |
| 2018/0087398 | A1 | 3/2018 | Forcier | |
| 2018/0163561 | A1* | 6/2018 | Norton | F23M 11/04 |
| 2018/0216473 | A1* | 8/2018 | Hill | F01D 5/181 |
| 2018/0306059 | A1 | 10/2018 | Ranjan | |
| 2020/0109639 | A1 | 4/2020 | Namadevan | |

OTHER PUBLICATIONS

EP search report for EP22176026.7 dated Oct. 17, 2022.

* cited by examiner

*Primary Examiner* — Jacob M Amick
*Assistant Examiner* — Charles J Brauch
(74) *Attorney, Agent, or Firm* — Getz Balich LLC

(57) ABSTRACT

An assembly is provided for a turbine engine. This turbine engine assembly includes a turbine engine airfoil and a heat pipe. The heat pipe is configured with the turbine engine airfoil. The heat pipe includes a closed-loop internal fluid circuit.

19 Claims, 9 Drawing Sheets

HEAT PIPE FOR A TURBINE ENGINE

BACKGROUND OF THE DISCLOSURE

1. Technical Field

This disclosure relates generally to a turbine engine and, more particularly, to heat transfer within a turbine engine.

2. Background Information

A modern gas turbine engine includes various internal components that are subject to relatively high temperatures. To prevent material fatigue and deterioration, it is known in the art to bleed compressed air from a compressor section of the turbine engine and route that bleed air to select internal components for cooling. Bleeding compressed air from the compressor section, however, decreases efficiency of the turbine engine. In addition, as turbine engines are made more and more compact, it may be increasingly more difficult to include internal passages for routing the bleed air from the compressor section to the air cooled components. There is a need in the art therefore for alternative techniques for cooling internal components/structures of a turbine engine.

SUMMARY OF THE DISCLOSURE

According to an aspect of the present disclosure, an assembly is provided for a turbine engine. This turbine engine assembly includes a turbine engine airfoil and a heat pipe. The heat pipe is configured with the turbine engine airfoil. The heat pipe includes a closed-loop internal fluid circuit.

According to another aspect of the present disclosure, another assembly is provided for a turbine engine. This turbine engine assembly includes a turbine engine case and a heat pipe. The heat pipe includes a working fluid and a closed-loop internal fluid circuit. The closed-loop internal fluid circuit extends within a sidewall of the turbine engine case. The heat pipe is configured to flow the working fluid through the closed-loop internal fluid circuit.

According to still another aspect of the present disclosure, an apparatus is provided for a turbine engine. This turbine engine apparatus includes a heat pipe that extends longitudinally between a first end and a second end. The heat pipe includes a working fluid, a gas passage, a liquid passage and a lattice structure in contact with the working fluid. The heat pipe is configured to flow the working fluid in a gaseous phase through the gas passage. The heat pipe is configured to flow the working fluid in a liquid phase through the liquid passage.

The turbine engine assembly may also include a turbine engine vane. The closed-loop internal fluid circuit may extend within the turbine engine vane.

The turbine engine apparatus may also include a turbine engine component. The gas passage and the liquid passage may extend within the turbine engine component.

The gas passage and the liquid passage may be at least partially formed by and extend through the lattice structure.

The lattice structure may be disposed within the liquid passage.

The turbine engine airfoil may be configured as a vane.

The vane may be configured as or otherwise include a turbine vane or a diffuser vane.

The heat pipe may be formed integral with the turbine engine airfoil.

A passage of the heat pipe may extend within the turbine engine airfoil.

The heat pipe may also include a working fluid. The heat pipe may be configured to circulate the working fluid through the closed-loop internal fluid circuit.

The closed-loop internal fluid circuit may include a first passage and a second passage. The heat pipe may be configured to flow the working fluid in a first phase through the first passage. The heat pipe may be configured to flow the working fluid in a second phase through the second passage. The heat pipe may include a lattice structure that forms the first passage and the second passage.

The closed-loop internal fluid circuit may include a first passage and a second passage. The heat pipe may be configured to flow the working fluid in a first phase through the first passage. The heat pipe may be configured to flow the working fluid in a second phase through the second passage. The heat pipe may include a lattice structure within the second passage.

The closed-loop internal fluid circuit may include a first passage and a second passage. The heat pipe may be configured to flow the working fluid in a first phase through the first passage. The heat pipe may be configured to flow the working fluid in a second phase through the second passage. The heat pipe may include sintered powder within the second passage.

The heat pipe may include a working fluid, a gas passage and a liquid passage. The heat pipe may be configured to: (A) transfer heat energy into the working fluid in a liquid phase at a first end of the heat pipe to at least partially change phase of the working fluid into a gaseous phase; (B) direct the working fluid in the gaseous phase through the gas passage from the first end of the heat pipe to a second end of the heat pipe; (C) transfer the heat energy out of the working fluid in the gaseous phase at the second end of the heat pipe to at least partially change phase the working fluid into the liquid phase; and (D) direct the working fluid in the liquid phase through the liquid passage from the second end of the heat pipe to the first end of the heat pipe.

The turbine engine assembly may also include a turbine engine case. The airfoil may be connected to the turbine engine case. The heat pipe may also be configured with a sidewall of the turbine engine case.

The turbine engine assembly may also include a second turbine engine airfoil connected to the turbine engine case. The heat pipe may be configured with the second turbine engine airfoil.

The turbine engine case may be radially between the turbine engine airfoil and the second turbine engine airfoil. A passage of the heat pipe may extend out of the turbine engine airfoil, through the sidewall of the turbine engine case, and into the second turbine engine airfoil.

The turbine engine assembly may also include thermal insulation surrounding a portion of the heat pipe.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
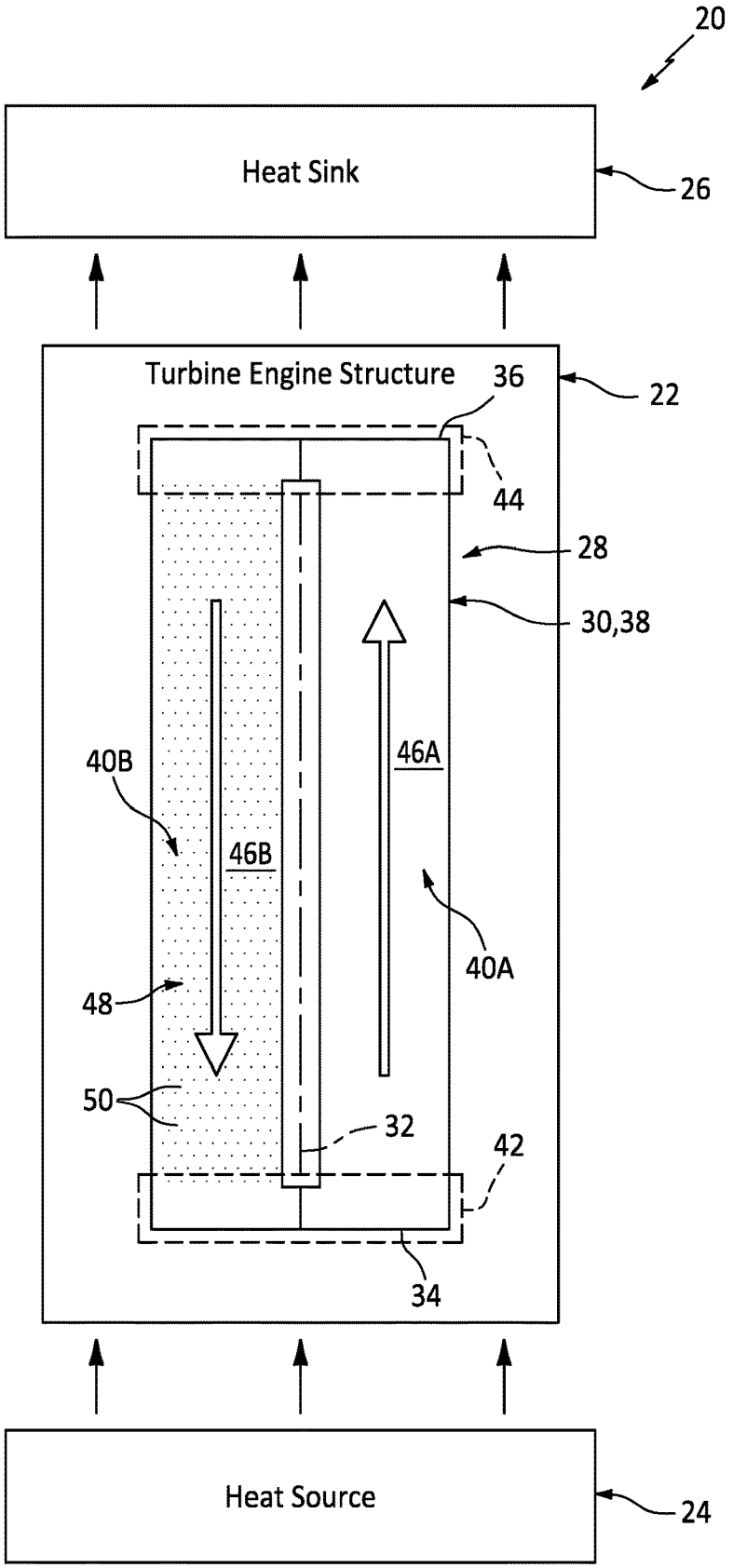
FIG. 1 is a schematic illustration of an assembly for a turbine engine.

FIG. 1 is a schematic illustration of an assembly 20 for a gas turbine engine. This turbine engine assembly 20 includes a turbine engine structure 22, a heat source 24 and a heat sink 26. The turbine engine assembly 20 also includes a (e.g., passive) heat transfer device 28 between and thermally coupled with the heat source 24 and the heat sink 26.

The turbine engine structure 22 may be configured as any component, or assembly of components, within the turbine engine. The turbine engine structure 22, for example, may be configured as or otherwise include an aero component disposed within and/or otherwise configured to interact with fluid (e.g., core gas) flowing through a flowpath (e.g., a core flowpath) of the turbine engine. An example of such an aero component is a turbine engine airfoil such as, but not limited to, a fixed or variable turbine engine vane or an airfoil of a turbine engine rotor blade. The turbine engine structure 22 may also or alternatively be configured as or otherwise include a flowpath component configured to form a peripheral boundary of the flowpath of the turbine engine. An example of such a flowpath component is a turbine engine case. The present disclosure, however, is not limited to such exemplary turbine engine structure components. The turbine engine structure 22, for example, may also or alternatively be configured as or otherwise include a support structure component such as, but not limited to, a strut or a frame.

The heat source 24 may be configured as any component, assembly of components and/or fluid(s) within the turbine engine that generates heat energy, conveys heat energy and/or is otherwise subject to relatively high quantities of heat energy. The heat source 24, for example, may be a combustor of the turbine engine and/or combustion products (e.g., hot core gas) directed from the combustor into and through a turbine section of the turbine engine. Of course, various other heat sources (e.g., bodies and/or fluids) capable of generating heat energy, conveying heat energy and/or that are otherwise subject to relatively high quantities of heat energy are present in a turbine engine, and the present disclosure is not limited to any particular ones thereof.

The heat sink 26 may be configured as any component, assembly of components and/or fluid(s) within the turbine engine capable of absorbing heat energy. The heat sink 26, for example, may be a diffuser duct of the turbine engine and/or fluid (e.g., relatively cool core gas) directed through the diffuser duct into a diffuser plenum surrounding the combustor. Of course, various other heat sinks (e.g., bodies and/or fluids) capable of absorbing heat energy are present in a turbine engine, and the present disclosure is not limited to any particular ones thereof.

The heat transfer device 28 is configured to (e.g., passively) transfer heat energy between the heat source 24 and the heat sink 26. More particularly, the heat transfer device 28 is configured to receive (e.g., absorb) heat energy from the heat source 24 and then transfer (e.g., reject) that received heat energy into the heat sink 26. The heat transfer device 28 may thereby cool the heat source 24 and heat the heat sink 26.

The heat transfer device 28 of FIG. 1 is configured as or otherwise includes a heat pipe 30. This heat pipe 30 extends longitudinally along a longitudinal centerline 32 between and to a first end 34 of the heat pipe 30 and a second end 36 of the heat pipe 30 that is longitudinally opposite the heat pipe first end 34. The heat pipe first end 34 is located at (e.g., on, adjacent or proximate) and/or otherwise thermally coupled with the heat source 24. The heat pipe first end 34 may thereby be referred to as a hot end/a heat absorption end of the heat pipe 30 during turbine engine operation. The heat pipe second end 36 is located at (e.g., on, adjacent or proximate) and/or otherwise thermally coupled with the heat sink 26. The heat pipe second end 36 may thereby be referred to as a cold end/a heat rejection end of the heat pipe 30 during turbine engine operation.

The heat pipe 30 includes a closed-loop internal fluid circuit 38 for circulating a working fluid (e.g., a phase change material) within the heat pipe 30 between the heat pipe first end 34 and the heat pipe second end 36. The fluid circuit 38 of FIG. 1, for example, includes a gas passage 40A (e.g., a gaseous phase working fluid passage) and a liquid passage 40B (e.g., a liquid phase working fluid passage). These fluid circuit passages 40A and 40B (generally referred to as "40") extend, in parallel, within the heat pipe 30 from or about the heat pipe first end 34 to or about the heat pipe second end 36. An outlet from the liquid passage 40B is fluidly coupled with an inlet to the gas passage 40A via a coupling or other interface at the heat pipe first end 34. An outlet from the gas passage 40A is fluidly coupled with an inlet to the liquid passage 40B via a coupling or other interface at the heat pipe second end 36.

The working fluid is configured as is a multi-phase (e.g., two-phase) working fluid. The working fluid, for example, is operable to change phase between a gaseous phase and a liquid phase during heat pipe operation. An example of the working fluid is a fluid including sodium (Na) and/or potassium (K). Another example of the working fluid is refrigerant. The present disclosure, however, is not limited to the foregoing exemplary working fluids.

During turbine engine operation, the heat pipe 30 transfers heat energy from the heat source 24 into the working fluid at the heat pipe first end 34. More particularly, the heat pipe 30 transfers the heat energy into a quantity of the working fluid within a first phase change region 42 (e.g., an evaporator and/or a vaporizer) of the heat pipe 30 at the heat pipe first end 34. During this heat energy transfer, the working fluid within the first phase change region 42 absorbs at least some or all of the heat energy received from the heat source 24. This heat energy absorption heats the working fluid such that a liquid phase of the working fluid ("liquid working fluid") may change phase to a gaseous phase of the working fluid ("gaseous working fluid"). The liquid working fluid may thereby evaporate or vaporize into the gaseous working fluid. This gaseous working fluid is subsequently directed (e.g., flows) through the gas passage 40A from the heat pipe first end 34 to the heat pipe second end 36.

At the heat pipe second end 36, the heat pipe 30 transfers heat energy (e.g., some or all of the heat energy previous absorbed from the heat source 24) from the working fluid into the heat sink 26. More particularly, the heat pipe 30 transfers the heat energy out of a quantity of the working fluid within a second phase change region 44 (e.g., a condenser) of the heat pipe 30 at the heat pipe second end 36. During this heat energy transfer, the working fluid within the second phase change region 44 rejects at least some or all of the heat energy into the heat sink 26. This heat energy rejection cools the working fluid such that the gaseous phase of the working fluid may change phase to the liquid phase of the working fluid. The gaseous working fluid may thereby condense into the liquid working fluid. This liquid working fluid is subsequently directed (e.g., flows) through the liquid passage 40B from the heat pipe second end 36 back to the heat pipe first end 34 in order to, for example, repeat the heat transfer cycle.

To promote the flow of the gaseous phase of the working fluid through the gas passage 40A from the heat pipe first end 34 to the heat pipe second end 36, the gas passage 40A may be configured substantially unobstructed. An internal channel 46A (e.g., bore) of the gas passage 40A, for example, may be hollow; e.g., empty except for the working fluid therein. In addition or alternatively, the heat pipe 30 may be arranged such that the heat pipe second end 36 is vertically above (with respect to gravity) the heat pipe first end 34. The heat transfer device 28 and its heat pipe 30, of course, may also or alternatively utilize one or more other devices and/or fluid principles to promote the flow of the gaseous working fluid through the gas passage 40A and its channel 46A.

Figure 2:
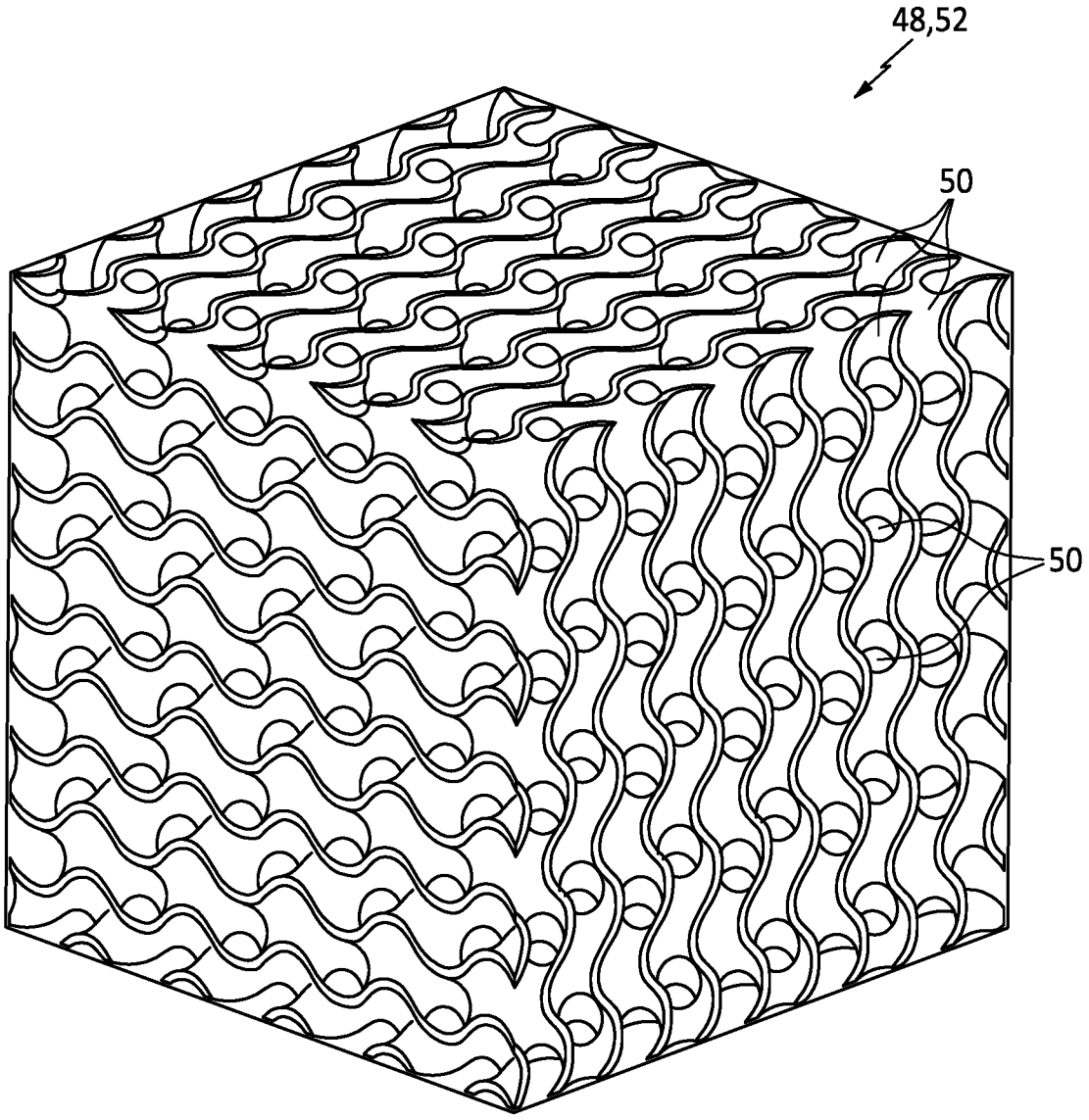
FIG. 2 is a partial perspective illustration of a lattice structure.
Figure 3:
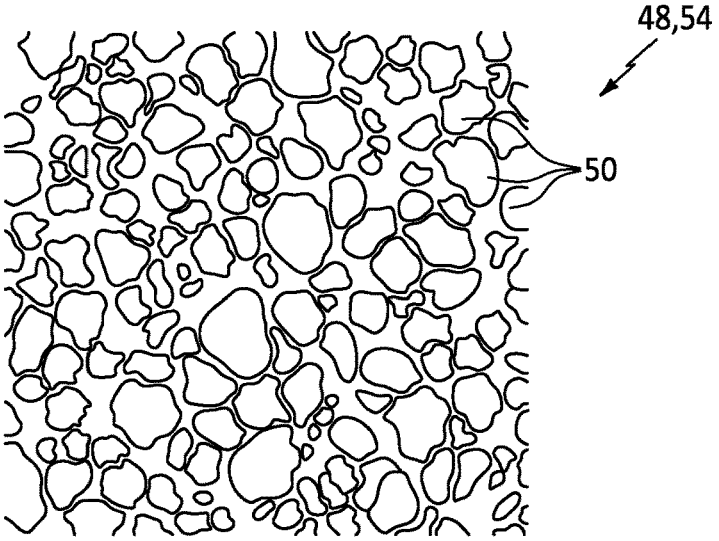
FIG. 3 is a partial sectional illustration of open cell foam.
Figure 4:
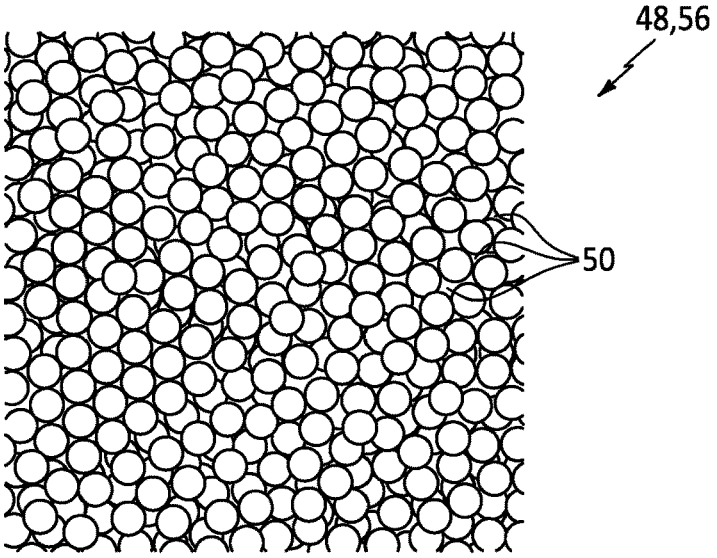
FIG. 4 is a partial sectional illustration of packed and/or sintered powder.
Figure 5:
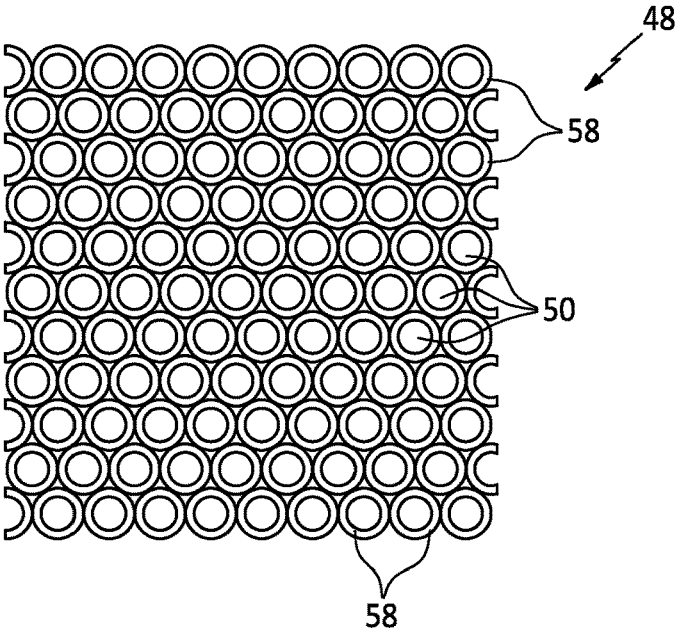
FIG. 5 is a partial sectional illustration of a plurality of capillary tubes.

To promote the flow of the liquid phase of the working fluid through the liquid passage 40B from the heat pipe second end 36 to the heat pipe first end 34, the liquid passage 40B may be configured with a wicking structure 48. An internal channel 46B (e.g., bore) of the liquid passage 40B, for example, may be at least partially or completely filled with material (the wicking structure 48) having a network of interconnected interstices 50; e.g., pores, cavities, voids, gaps, spaced, micro channels, etc. The interstices 50 may be sized to promote a capillary action (e.g., wicking) of the liquid working fluid. The liquid passage channel 46B, for example, may be at least partially or completely filled with: a lattice structure 52 (see FIG. 2) such as, but not limited to, a Schwarz P-type lattice structure; open cell foam 54 (see FIG. 3); and/or packed and/or sintered powder 56 (see FIG. 4). In another example, the liquid passage channel 46B may be at least partially or completely configured with (e.g., filled with or formed by) a plurality of capillary tubes 58 (see FIG. 5). In still another example, internal surfaces of the heat pipe 30 (e.g., passage sidewall surfaces) may be provided with a rough surface finish. In addition or alternatively, the heat pipe 30 may be arranged such that the heat pipe second end 36 is vertically above (with respect to gravity) the heat pipe first end 34 such that gravity draws the liquid working fluid back towards the heat pipe first end 34. The heat transfer device 28 and its heat pipe 30, of course, may also or alternatively utilize one or more other devices and/or fluid principles to promote the flow of the liquid working fluid through the liquid passage 40B.

As turbine engine design trends continue to push bounds of performance and efficiency as well as turbine engine applications, turbine engines may be made more-and-more compact and lightweight. To accommodate these design trends, the heat transfer device 28 of FIG. 1 and its heat pipe 30 may be configured with one or more other components of the turbine engine. The heat pipe 30 of FIG. 1, in particular, is formed integral with the turbine engine structure 22. The heat pipe 30 and its fluid circuit passages 40, for example, are at least partially (or completely) formed by and extend within the turbine engine structure 22. Incorporating the heat pipe 30 with the turbine engine structure 22 therefore may not require any additional space, but may provide enhanced cooling for the turbine engine. For example, the heat pipe 30 may be integrated into a component of the turbine engine that may otherwise by configured as a solid (not hollow) structure; e.g., a solid airfoil, a solid case sidewall, etc. In addition, provision of the heat pipe 30 may reduce or eliminate a need for more traditional cooling techniques such as air cooling which may be particularly difficult to implement in compact turbine engines. Furthermore, since the heat pipe 30 is a closed system, the heat pipe 30 is not subject to clogging due to debris (e.g., sand, dirt, etc.) carried by air entering the turbine engine. Such debris may be particularly disruptive for air cooled components with small cooling holes and/or passages where even small deposits of the debris can clog or otherwise disrupt proper function of cooling holes and/or passages.

Figure 6:
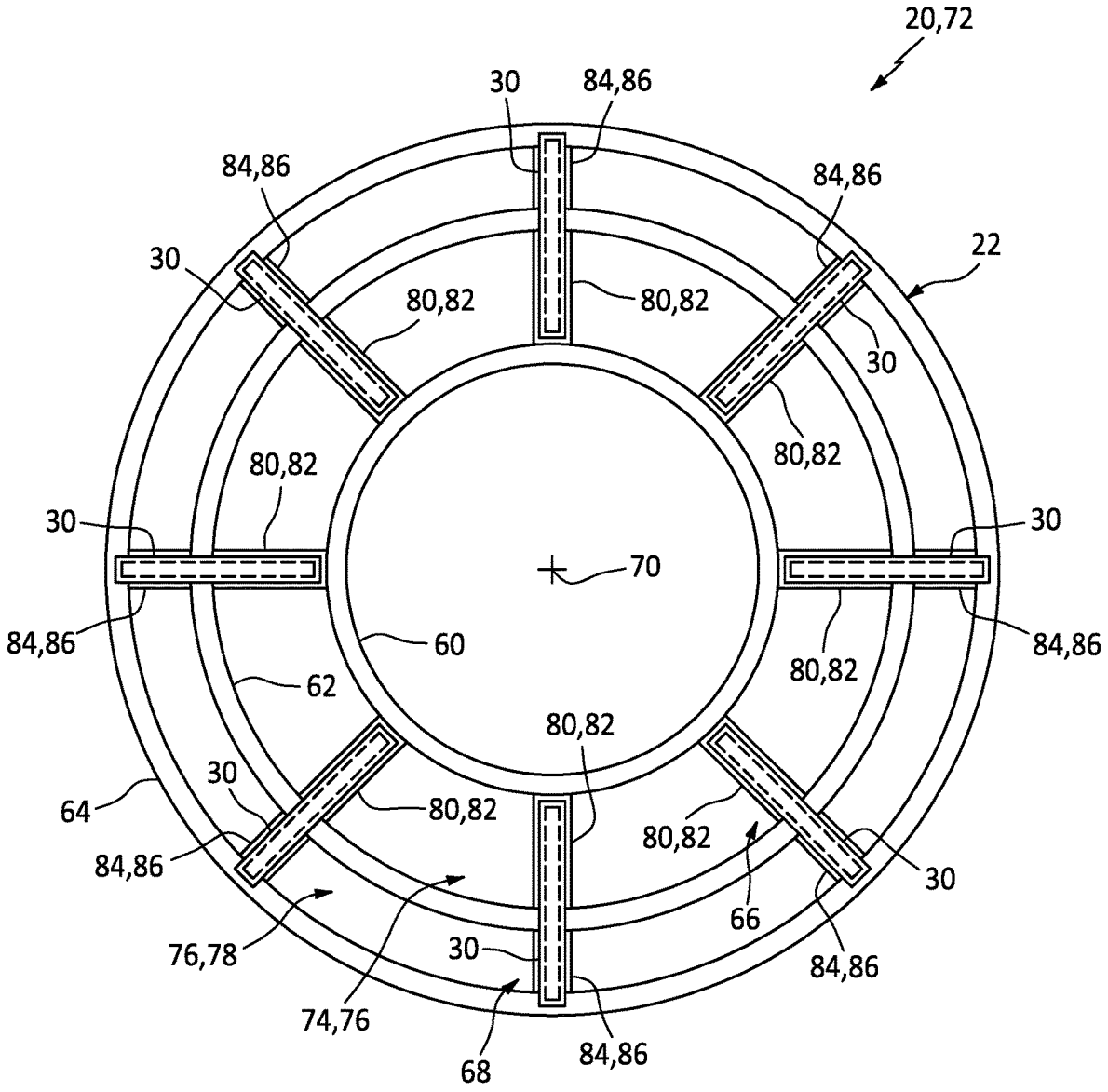
FIG. 6 is a schematic cross-sectional illustration of a turbine engine structure configured with one or more heat pipes.
Figure 7:
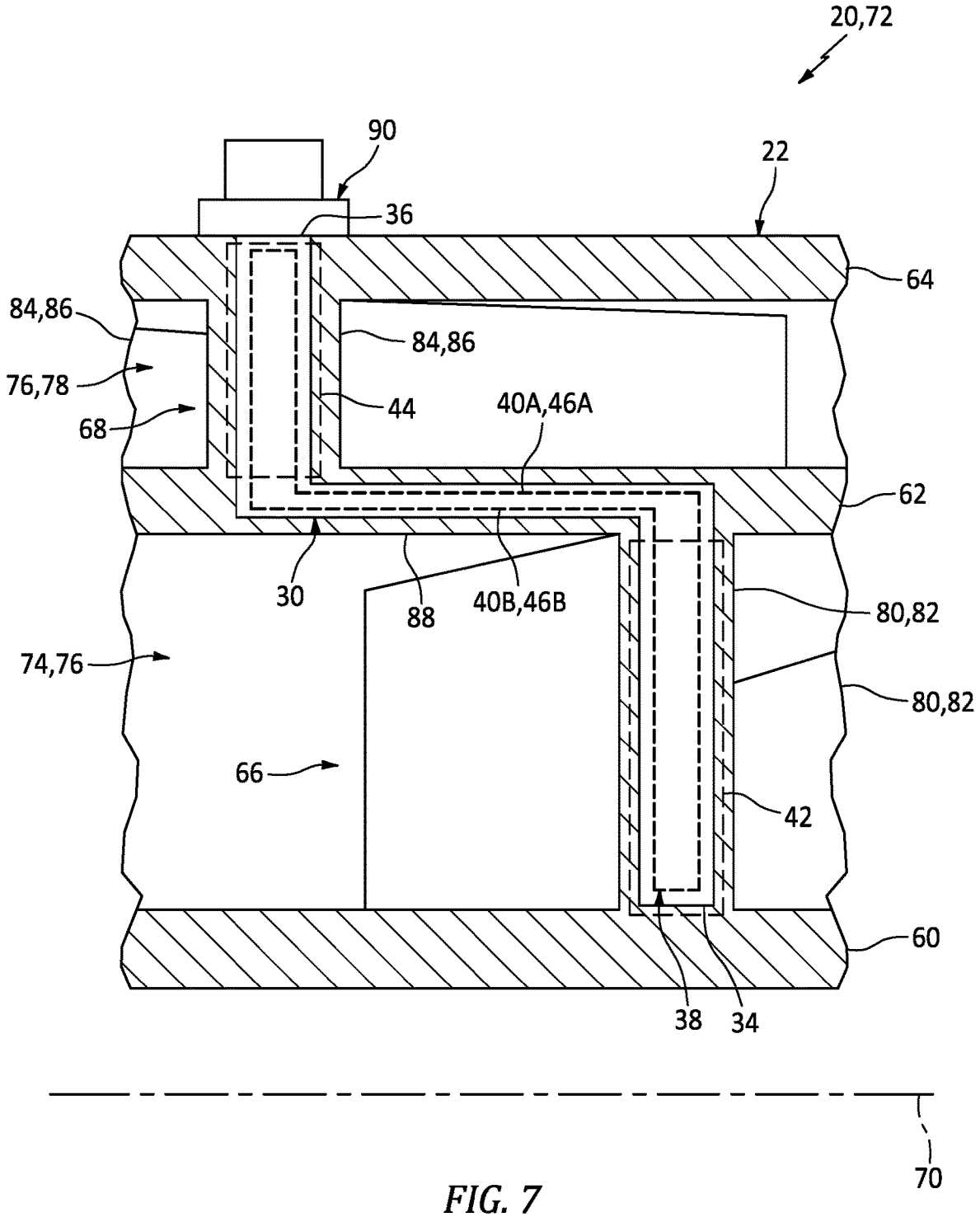
FIG. 7 is a schematic side sectional illustration of a portion of the turbine engine structure and a respective heat pipe.

Referring to FIGS. 6 and 7, the turbine engine structure 22 may include an inner case 60 (e.g., an inner turbine case), an intermediate case 62 (e.g., an outer turbine case) and an outer case 64 (e.g., a diffuser case). The turbine engine structure 22 of FIGS. 6 and 7 also includes an inner nozzle 66 (e.g., a turbine nozzle) and an outer nozzle 68 (e.g., a diffuser nozzle).

Each of the turbine engine cases 60, 62, 64 extends circumferentially about (e.g., completely around) an axial centerline 70 of the turbine engine 72. Each of the turbine engine cases 60, 62, 64 may thereby be configured as a tubular wall within the turbine engine 72.

The inner case 60 is disposed radially within the intermediate case 62 such that the intermediate case 62 circumscribes and axially overlaps the inner case 60. The turbine engine cases 60 and 62 are radially spaced from one another so as to form an inner (e.g., annular) duct 74 therebetween. This inner duct 74 may be configured as a turbine inlet duct. The inner duct 74 may thereby form a (e.g., downstream) portion of the core flowpath 76 within the turbine engine 72; e.g., see FIG. 13. The present disclosure, however, is not limited to such an exemplary duct configuration.

The intermediate case 62 is disposed radially within the outer case 64 such that the outer case 64 circumscribes and axially overlaps the intermediate case 62. The turbine engine cases 62 and 64 are radially spaced from one another so as to form an outer (e.g., annular) duct 78 therebetween. This outer duct 78 may be configured as a diffuser inlet duct. The outer duct 78 may thereby form a (e.g., upstream) portion of the core flowpath 76 within the turbine engine 72; e.g., see FIG. 13. The present disclosure, however, is not limited to such an exemplary duct configuration. Furthermore, in other embodiments, the flowpath formed by the inner duct 74 may be different than (e.g., fluidly decoupled from, fluidly parallel with, etc.) the flowpath formed by the outer duct 78.

The inner nozzle 66 is arranged within the inner duct 74. The inner nozzle 66, for example, is arranged radially between the inner case 60 and the intermediate case 62. The inner nozzle 66 includes a plurality of inner nozzle vanes 80 (e.g., turbine vanes) arranged circumferentially about the axial centerline 70 in an annular array. Each of these inner nozzle vanes 80 has an inner nozzle airfoil 82 that extends radially between and is connected to the inner case 60 and the intermediate case 62. The inner nozzle airfoils 82 may be configured to condition (e.g., turn) gas (e.g., the core gas) flowing through the inner nozzle 66. In addition or alternatively, the inner nozzle vanes 80 and their airfoils 82 may be configured to structurally connect the turbine engine cases 60 and 62 together.

The inner nozzle 66 may be configured as a turbine nozzle. The inner nozzle 66, for example, may be configured as a nozzle arranged at an outlet of a combustion chamber and an inlet to a turbine section; e.g., see FIG. 13. The present disclosure, however, is not limited to such an exemplary inner nozzle configuration.

The outer nozzle 68 is arranged within the outer duct 78. The outer nozzle 68, for example, is arranged radially between the intermediate case 62 and the outer case 64. The outer nozzle 68 includes a plurality of outer nozzle vanes 84 (e.g., diffuser vanes) arranged circumferentially about the axial centerline 70 in an annular array. Each of these outer nozzle vanes 84 has an outer nozzle airfoil 86 that extends radially between and is connected to the intermediate case 62 and the outer case 64. The outer nozzle airfoils 86 may be configured to condition (e.g., turn) gas (e.g., the core gas) flowing through the outer nozzle 68. In addition or alternatively, the outer nozzle vanes 84 and their airfoils 86 may be configured to structurally connect the turbine engine cases 62 and 64 together.

The outer nozzle 68 may be configured as a diffuser nozzle. The outer nozzle 68, for example, may be configured as a nozzle arranged at an outlet of a compressor section and an inlet to the diffuser plenum; e.g., see FIG. 13. The present disclosure, however, is not limited to such an exemplary inner nozzle configuration.

Referring to FIG. 6, the turbine engine structure 22 is configured with one or more of the heat pipes 30. Referring now to FIG. 7, each heat pipe 30 is configured with one or more of the turbine engine structure components 62, 64, 66 and 68. Each heat pipe 30 of FIG. 7, for example, is formed integral with a respective one of the inner nozzle vanes 80 and its airfoil 84, the intermediate case 62, and a respective one of the outer nozzle vanes 84 and its airfoil 86. Each heat pipe 30 may also be formed integral with the outer case 64. More particularly, each heat pipe 30 of FIG. 7 may be formed by and within the respective turbine engine structure components 62, 64, 66 and 68. The fluid circuit 38 and its passages, for example, are formed by and extend within the respective turbine engine structure components 62, 64, 66 and 68.

The first phase change region 42 and respective longitudinal lengths of the fluid circuit passages 40 are formed by and extend within the respective inner nozzle vane 80 and its airfoil 82. The heat pipe first end 34, for example, is located at a connection/interface between the respective inner nozzle vane 80 and the inner case 60. The fluid circuit passages 40 extend within an interior of the respective inner nozzle vane 80 along a span of the inner nozzle vane 80 to the intermediate case 62. The fluid circuit passage channels 46 may thereby be respectively formed by internal bores within the respective inner nozzle vane 80, and walls of the fluid circuit passages 40 may thereby be formed by material/walls of the respective inner nozzle vane 80.

An intermediate portion of the fluid circuit 38 and respective longitudinal lengths of the fluid circuit passages 40 are formed by and extend within the intermediate case 62. The fluid circuit passages 40, for example, extend axially within an interior of a sidewall 88 of the intermediate case 62 from a connection/interface between the respective inner nozzle vane 80 and the intermediate case 62 to a connection/interface between the intermediate case 62 and the respective outer nozzle vane 84. The fluid circuit passage channels 46 may thereby be respectively formed by internal bores within the intermediate case sidewall 88, and walls of the fluid circuit passages 40 may thereby be formed by material/walls of the intermediate case 62.

The second phase change region 44 and respective longitudinal lengths of the fluid circuit passages 40 are formed by and extend within the respective outer nozzle vane 84 and its airfoil 86. The heat pipe second end 36, for example, is located at a connection/interface between the respective outer nozzle vane 84 and the outer case 64. The fluid circuit passages 40 extend within an interior of the respective outer nozzle vane 84 along a span of the outer nozzle vane 84 to the intermediate case 62. The fluid circuit passage channels 46 may thereby be respectively formed by internal bores within the respective outer nozzle vane 84, and walls of the fluid circuit passages 40 may thereby be formed by material/walls of the respective outer nozzle vane 84.

With the foregoing arrangement, each heat pipe 30 is configured to absorb heat energy from the respective inner nozzle vane 80 (e.g., turbine vane) and thereby cool that inner nozzle vane 80. This transfer of heat energy may aid in protecting the respective inner nozzle vane 80 from relatively high temperature gas (e.g., combustion products) flowing through the inner nozzle 66. Cooling for the inner nozzle vanes 80 may also be tailored to account for hot streaks in the gas flowing through the inner nozzle 66. Each heat pipe 30 is also configured to reject the absorbed heat energy into the respective outer nozzle vane 84 (e.g., diffuser vane) and thereby heat that outer nozzle vane 84. This transfer of heat energy may aid in pre-heating relatively low temperature gas (e.g., compressed air) flowing through the outer nozzle 68, which can increase turbine engine efficiency.

The heat pipe 30 may be provided with an access port 90 (e.g., a fill port) at the heat pipe second end 36. This access port 90 may be configured to facilitate one or more operations. Examples of these operations may include, but are not limited to:

- Filling the fluid circuit 38 with the working fluid;
- Placing the fluid circuit 38 under a partial vacuum;
- Evacuating non-fused powder where the heat pipe 30 and/or the turbine engine structure 22 is/are at least partially or completely additive manufactured using a process such as, but not limited to, a laser powder bed fusion (LPBF) process or an electron beam powder bed fusion (EBPBF) process;
- Providing a vent for or environmental connection to the fluid circuit 38 during manufacture of the turbine engine structure 22 (e.g., during a hot isostatic pressing (HIP) operation) to prevent partial or complete closing of interstices 50 (e.g., see FIGS. 2-5) within the fluid circuit 38 (if included); and
- Inspecting the fluid circuit 38 and/or the surrounding turbine engine structure 22.

Figure 8:
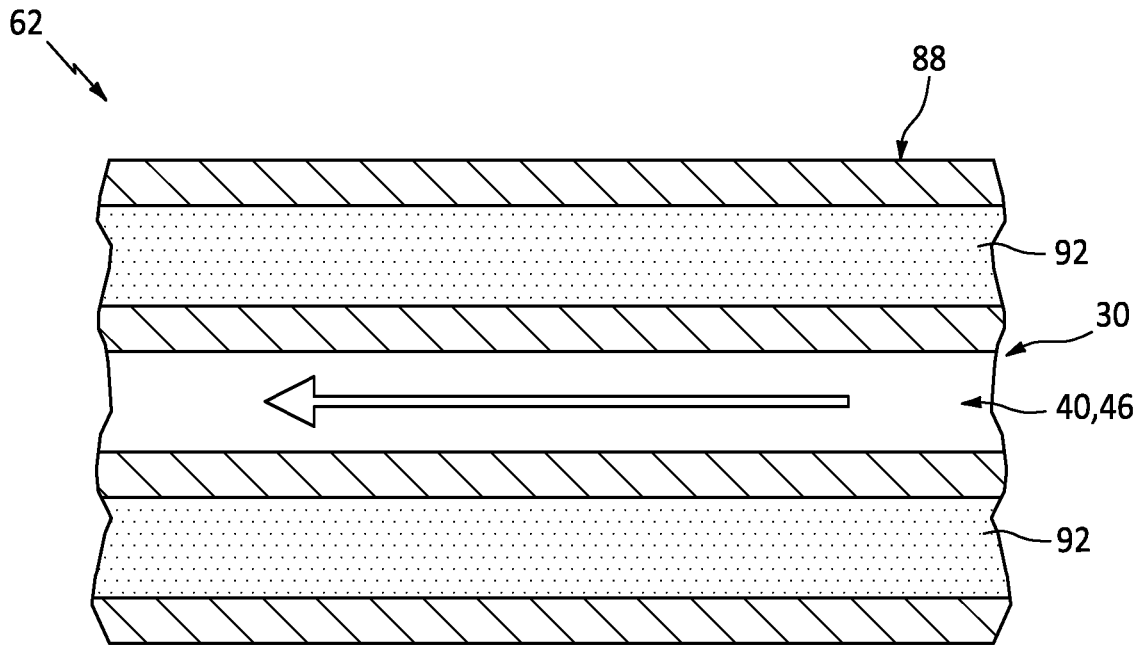
FIG. 8 is a partial sectional illustration of a sidewall of a turbine engine case configured with an internal passage of a respective heat pipe.

In some embodiments, referring to FIG. 8, one or more or all of the heat pipes 30 may each be configured with thermal insulation 92. This insulation 92 may be configured to prevent or reduce heat energy transfer between the working fluid and an outside environment between/outside of the phase change regions 42 and 44 (see FIG. 7). The insulation 92 of FIG. 8, for example, surrounds at least an intermediate portion of the heat pipe 30. More particularly, the insulation 92 of FIG. 8 (e.g., completely) surrounds at least a length of each fluid circuit passage 40 that extends within the intermediate case sidewall 88. The insulation 92 may be configured as open cell foam or another porous structure. The insulation 92 may be formed integral with the heat pipe 30 and/or the turbine engine structure 22. The present disclosure, however, is not limited to any particular insulation types or configurations.

Figure 9:
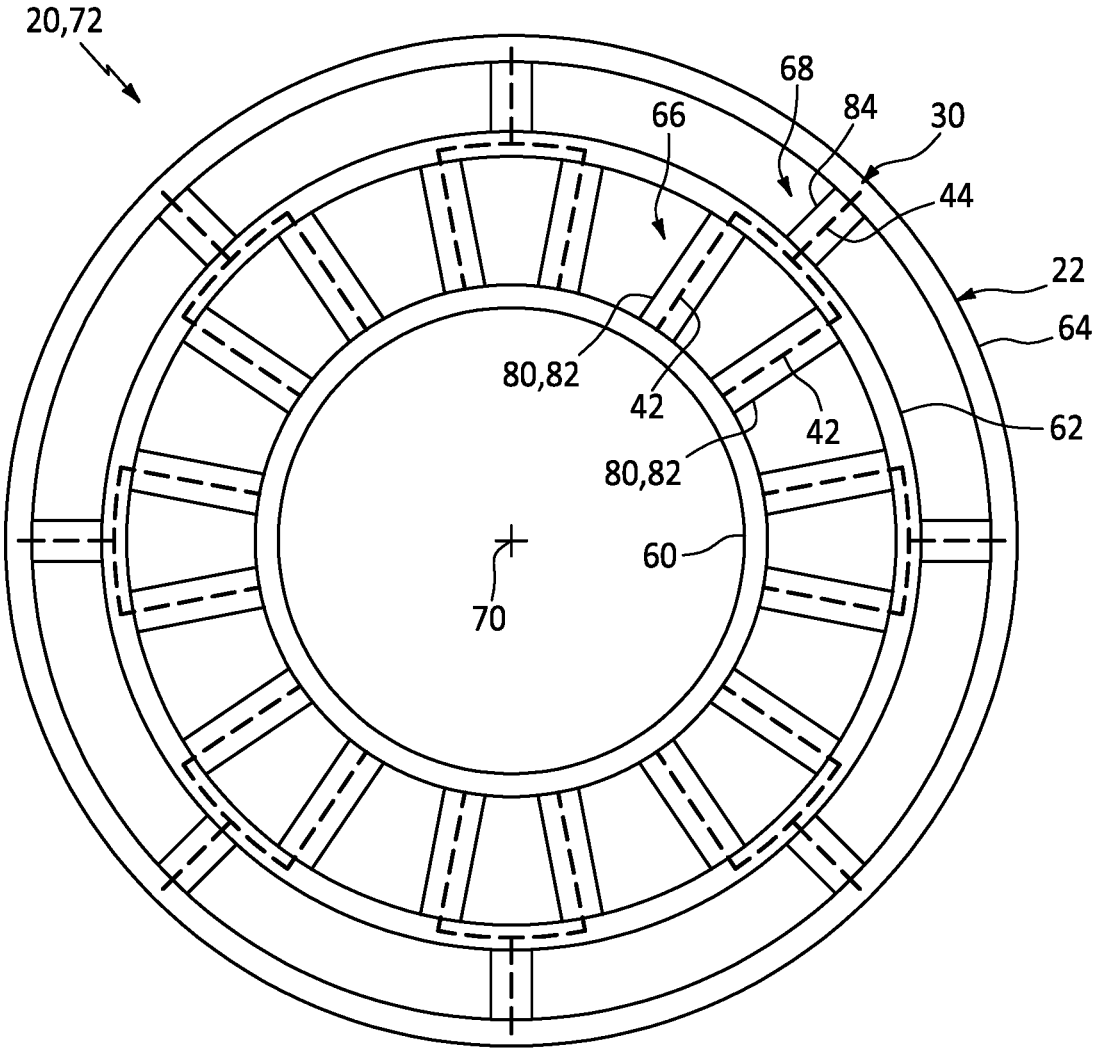
FIG. 9 is a schematic cross-sectional illustration of another turbine engine structure configured with one or more heat pipes.
Figure 10:
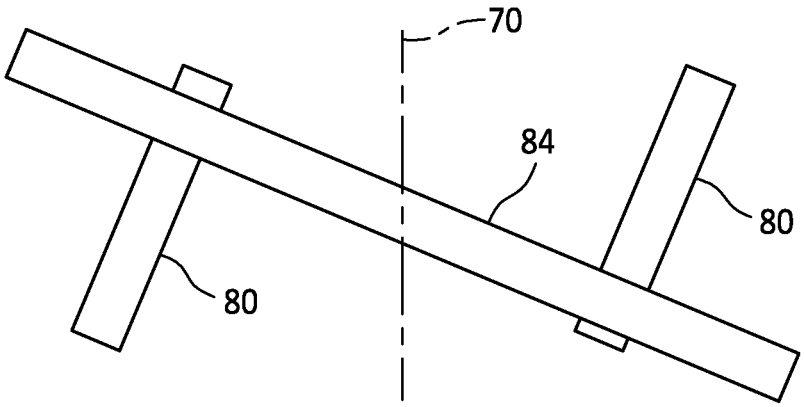
FIG. 10 is a schematic plan view illustration of an outer nozzle vane overlapping a set of inner nozzle vanes.

In some embodiments, referring to FIG. 6, each heat pipe 30 is configured with a respective single one of the inner nozzle vanes 80 and a respective single one of the outer nozzle vanes 84. In other embodiments, referring to FIG. 9, one or more of the heat pipes 30 may each be configured with more than one of the inner nozzle vanes 80. Each heat pipe 30 of FIG. 9, for example, includes a plurality of (e.g., parallel) the first phase change regions 42. Each of these first phase change regions 42 is configured with a respective one of the inner nozzle vanes 80 and its airfoil 82. Such an arrangement may be particularly useful where, for example, one of the outer nozzle vanes 84 (e.g., circumferentially and/or axially) overlaps more than one of the inner nozzle vanes 80 as shown in FIG. 10. Of course, one or more of the heat pipes 30 may also or alternatively each be configured with more than one of the outer nozzle vanes 84.

Figure 11A:
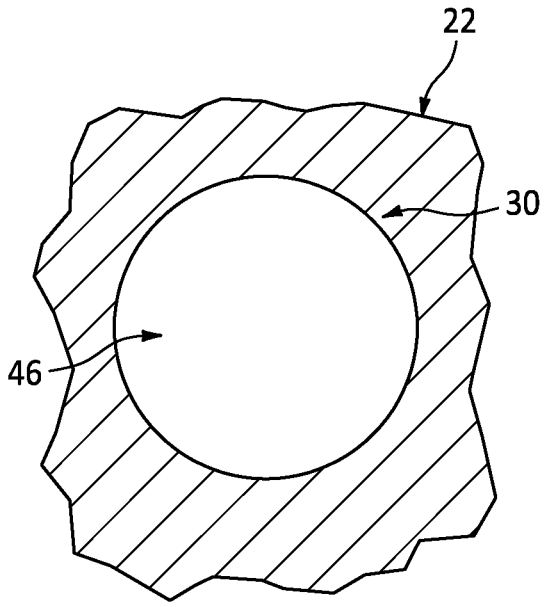
FIG. 11A is a sectional illustration of a hollow internal passage of a respective heat pipe.
Figure 11B:
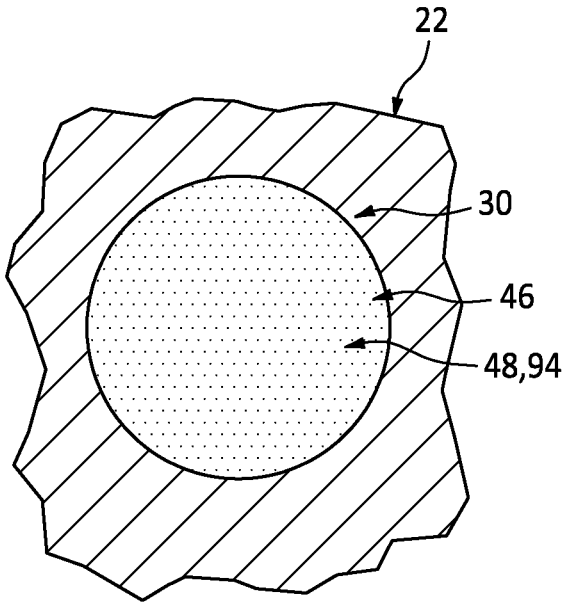
FIG. 11B is a sectional illustration of a filled internal passage of a respective heat pipe.

In some embodiments, referring to FIGS. 11A and B, each fluid circuit passage 40 may be configured as a single discrete channel 46 (or a plurality of discrete parallel channels) through the turbine engine structure 22. This passage channel 46 may be hollow (e.g., empty) as shown in FIG. 11A. Alternatively, at least a portion or an entirety of the passage channel 46 may be configured with (e.g., filled with and/or formed by) porous material 94 as shown in FIG. 11B; see also the wicking structure 48 of FIGS. 2-5.

Figure 12:
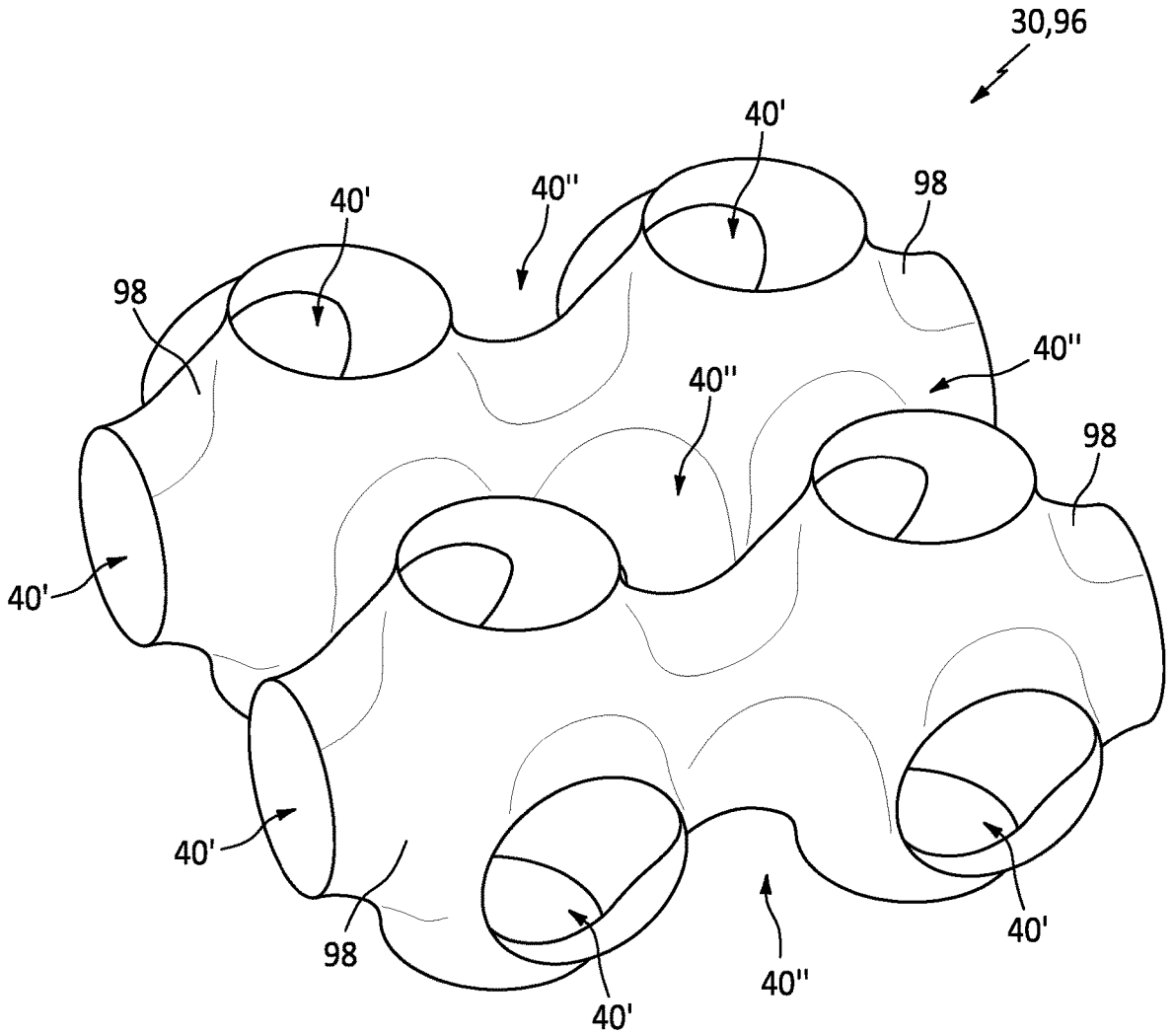
FIG. 12 is a perspective illustration of a lattice structure forming internal passages of a respective heat pipe.

In some embodiments, referring to FIG. 12, the gas passages 40A and/or the liquid passages 40B (see FIG. 1) may be configured as an interconnected network of sub-channels. The heat pipe 30 of FIG. 12, for example, is configured with an internal lattice structure 96 such as, but not limited to, a Schwarz P-type lattice structure. One of the fluid circuit passages 40' (e.g., 40A or 40B) may be formed by the lattice structure 96 within a plurality of (e.g., hollow) members 98 of the lattice structure 96. The other one of the fluid circuit passages 40" (e.g., 40B or 40A) may be formed by the lattice structure 96 outside of and in between the lattice members 98. Thus, sidewalls of the lattice members 98 provide a fluid barrier between the fluid circuit passages 40' and 40". In addition, one or more of the sub-channels of a respective fluid circuit channel 40' and/or 40" (e.g., 40B) may be configured with (e.g., filled with and/or formed by) additional porous material in a similar manner as described above; e.g., see the wicking structure 48 of FIGS. 2-5.

The heat pipe 30 and the turbine engine structure 22 may be integrated together using various different manufacturing and design techniques. For example, the heat pipe 30 and the turbine engine structure 22 may be formed as a (e.g., metal) monolithic body. The term monolithic may describe herein an apparatus which is formed as a single unitary body. The heat pipe 30 and the turbine engine structure 22, for example, may be additively manufactured, cast, machined and/or otherwise formed as an integral, unitary body. Alternatively, the turbine engine assembly 20 and any one or more of its elements may be formed as a non-monolithic body. The term non-monolithic may described an apparatus which includes a plurality of discretely formed parts, where those parts are mechanically fastened and/or otherwise attached to one another to form the apparatus.

The term additive manufacturing may describe a process where a component or components are formed by accumulating and/or fusing material together using an additive manufacturing device, typically in a layer-on-layer manner. Layers of powder material, for example, may be disposed and thereafter solidified sequentially onto one another to form the component(s). The term solidify may describe a process whereby material is sintered and/or otherwise melted thereby causing discrete particles or droplets of the sintered and/or melted material to fuse together. Examples of the additive manufacturing process include a laser powder bed fusion (LPBF) process and an electron beam powder bed fusion (EB-PBF) process. Examples of the additive manufacturing device include a laser powder bed fusion (LPBF) device and an electron beam powder bed fusion (EB-PBF) device. Of course, various other additive manufacturing processes and devices are known in the art, and the present disclosure is not limited to any particular ones thereof.

At least a portion of the fluid circuit 38 (e.g., the liquid passage 40B) may be at least partially or completely filled with a wicking structure 48 or other porous material as discussed above; e.g., see FIGS. 2-5. Where the heat pipe 30 is formed using additive manufacturing and the wicking structure 48 is configured as or otherwise includes the packed and/or sintered powder 56 (see FIG. 4), at least some of the excess powder used during the additive manufacturing process of the heat pipe 30 may be retained within the fluid circuit 38 (not evacuated) in order to form the wicking structure 48. Thus, no additional material may be required for forming the internal wicking structure 48, and the additive manufacturing process may be simplified by removing or limiting a powder evacuation step.

Integrating the heat pipe 30 with the turbine engine structure 22 may facilitate tailored cooling for the turbine engine structure 22. Integrating the heat pipe 30 with the turbine engine structure 22 may facilitate remote cooling of the certain turbine engine components; e.g., cooling without requiring a cooling air source. Integrating the heat pipe 30 with the turbine engine structure 22 may reduce turbine engine space requirements by providing a single component/structure with multiple functions; e.g., an airfoil may (1) condition gas flowing through a flowpath and (2) facilitate heat pipe heat energy transfer. Integrating the heat pipe 30 with the turbine engine structure 22 may also increase a service life of the turbine engine structure 22 or one or more other thermally coupled components, particularly where that turbine engine structure 22 or other component(s) would otherwise not receive cooling; e.g., impingement and/or effusion cooling.

Figure 13:
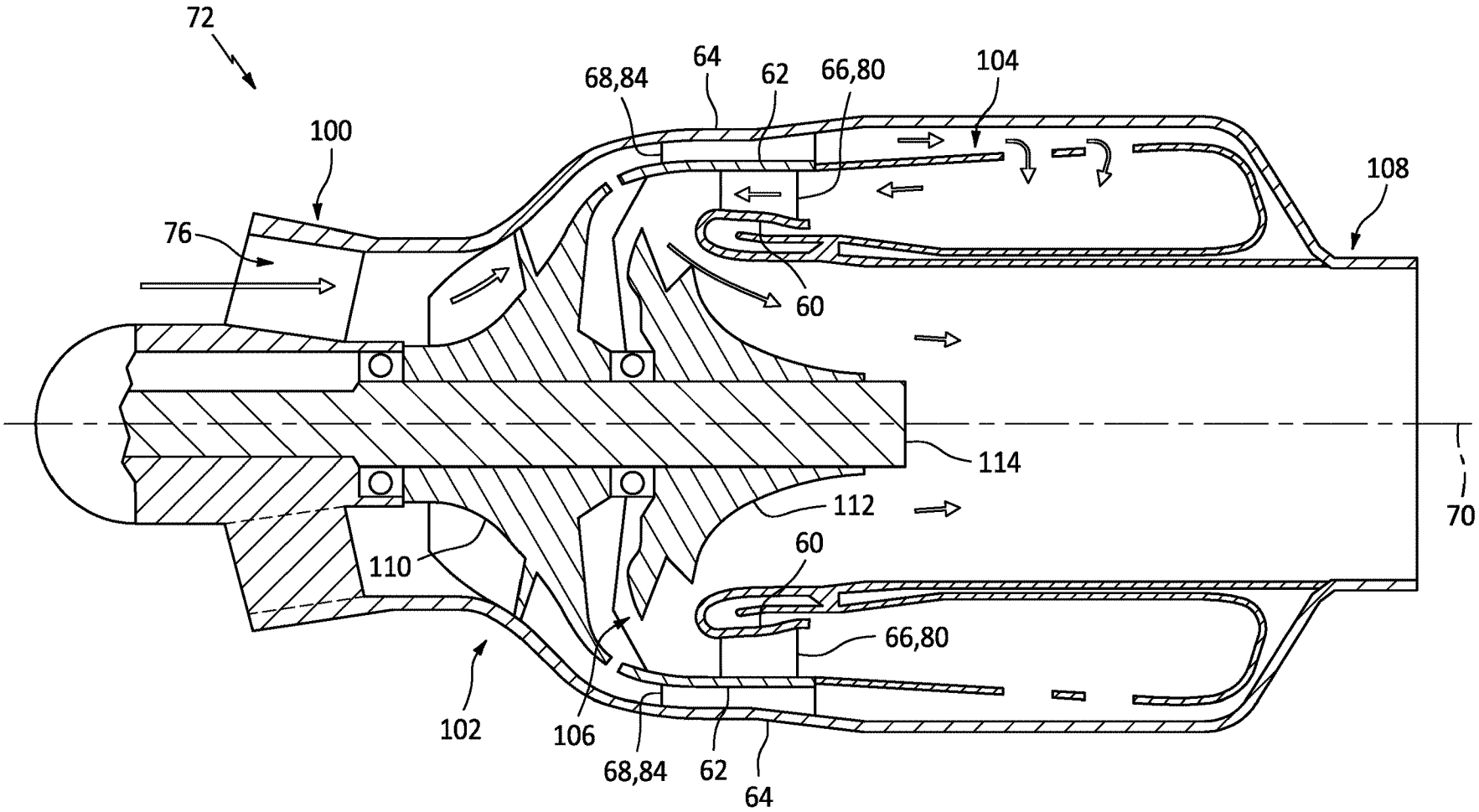
FIG. 13 is a side sectional illustration of a gas turbine engine.

The turbine engine assembly 20 of the present disclosure may be configured with various different types and configurations of turbine engines. FIG. 13 illustrates one such type and configuration of the turbine engine 72—a single spool, radial-flow turbojet turbine engine. This gas turbine engine 72 is configured for propelling an aircraft such as, but not limited to, an unmanned aerial vehicle (UAV), a drone or any other manned or unmanned aircraft or self-propelled projectile. The present disclosure, however, is not limited to such an exemplary turbojet turbine engine configuration nor to an aircraft propulsion system application. For example, the gas turbine engine may alternatively be configured as an auxiliary power unit (APU) or an industrial gas turbine engine.

In the specific embodiment of FIG. 13, the turbine engine 72 includes an upstream inlet 100, the (e.g., radial) compressor section 102, a combustor section 104, the (e.g., radial) turbine section 106 and a downstream exhaust 108 fluidly coupled in series. A compressor rotor 110 in the compressor section 102 is coupled with a turbine rotor 112 in the turbine section 106 by a shaft 114, which shaft 114 rotates about the axial centerline 70 (e.g., rotational axis) of the turbine engine 72.

The turbine engine assembly 20 and any one or more of its components may be included in various turbine engines other than the one described above. The heat pipe 30, for example, may be included in a geared turbine engine where a gear train connects one or more shafts to one or more rotors in a fan section, a compressor section and/or any other engine section. Alternatively, the heat pipe 30 may be included in a turbine engine configured without a gear train. The heat pipe 30 may be included in a geared or non-geared turbine engine configured with a single spool (see FIG. 13), with two spools, or with more than two spools. The turbine engine may be configured as a turbofan engine, a turbojet engine, a propfan engine, a pusher fan engine or any other type of turbine engine. The present disclosure therefore is not limited to any particular types or configurations of turbine engines.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. An assembly for a turbine engine, comprising:
- a turbine engine case comprising a sidewall;
- a first turbine engine airfoil connected to the turbine engine case;
- a second turbine engine airfoil connected to the turbine engine case; and
- a heat pipe configured with the sidewall, the first turbine engine airfoil and the second turbine engine airfoil, the heat pipe comprising a closed-loop internal fluid circuit.

2. The assembly of claim 1, wherein the first turbine engine airfoil is configured as a vane.

3. The assembly of claim 2, wherein the vane is a turbine vane or a diffuser vane.

4. The assembly of claim 1, wherein the heat pipe is formed integral with the first turbine engine airfoil.

5. The assembly of claim 1, wherein a passage of the heat pipe extends within the first turbine engine airfoil.

6. The assembly of claim 1, wherein
- the heat pipe further comprises a working fluid; and
- the heat pipe is configured to circulate the working fluid through the closed-loop internal fluid circuit.

7. The assembly of claim 6, wherein
- the closed-loop internal fluid circuit comprises a first passage and a second passage, the heat pipe is configured to flow the working fluid in a first phase through the first passage, and the heat pipe configured to flow the working fluid in a second phase through the second passage; and
- the heat pipe comprises a lattice structure that forms the first passage and the second passage.

8. The assembly of claim 6, wherein
- the closed-loop internal fluid circuit comprises a first passage and a second passage, the heat pipe is configured to flow the working fluid in a first phase through the first passage, and the heat pipe configured to flow the working fluid in a second phase through the second passage; and
- the heat pipe comprises a lattice structure within the second passage.

9. The assembly of claim 6, wherein
- the closed-loop internal fluid circuit comprises a first passage and a second passage, the heat pipe is configured to flow the working fluid in a first phase through the first passage, and the heat pipe configured to flow the working fluid in a second phase through the second passage; and
- the heat pipe comprises sintered powder within the second passage.

10. The assembly of claim 1, wherein the heat pipe comprises a working fluid, a gas passage and a liquid passage, and the heat pipe is configured to
- transfer heat energy into the working fluid in a liquid phase at a first end of the heat pipe to at least partially change phase of the working fluid into a gaseous phase;
- direct the working fluid in the gaseous phase through the gas passage from the first end of the heat pipe to a second end of the heat pipe;
- transfer the heat energy out of the working fluid in the gaseous phase at the second end of the heat pipe to at least partially change phase the working fluid into the liquid phase; and
- direct the working fluid in the liquid phase through the liquid passage from the second end of the heat pipe to the first end of the heat pipe.

11. The assembly of claim 1, wherein
- the turbine engine case is radially between the turbine engine airfoil and the second turbine engine airfoil; and
- a passage of the heat pipe extends out of the turbine engine airfoil, through the sidewall of the turbine engine case, and into the second turbine engine airfoil.

12. The assembly of claim 1, further comprising thermal insulation surrounding a portion of the heat pipe.

13. An assembly for a turbine engine, comprising:
- a first vane;
- a second vane;
- a turbine engine case between the first vane and the second vane; and
- a heat pipe comprising a working fluid and a closed-loop internal fluid circuit that extends through a sidewall of the turbine engine case from the first vane and into the second vane, the heat pipe configured to flow the working fluid through the closed-loop internal fluid circuit.

14. The assembly of claim 13, wherein the turbine engine case is radially between the first vane and the second vane.

15. An apparatus for a turbine engine, comprising:
- a heat pipe extending longitudinally between a first end and a second end;
- the heat pipe comprising a working fluid, a gas passage, a liquid passage and a lattice structure in contact with the working fluid in the gas passage and the liquid passage, the heat pipe configured to flow the working fluid in a gaseous phase through the gas passage, and the heat pipe configured to flow the working fluid in a liquid phase through the liquid passage.

16. The apparatus of claim 15, further comprising:

a turbine engine component;

the gas passage and the liquid passage extending within the turbine engine component.

17. The apparatus of claim 15, wherein the gas passage and the liquid passage are at least partially formed by and extend through the lattice structure.

18. The apparatus of claim 15, wherein the lattice structure comprises a Schwarz P-type lattice structure.

19. The apparatus of claim 15, further comprising:

an inner vane;

an outer vane; and a structure radially between the inner vane and the outer vane;

the gas passage and the liquid passage extending through the structure and into the inner vane and the outer vane.

* * * * *